US007635821B2

(12) United States Patent
Hamada

(10) Patent No.: US 7,635,821 B2
(45) Date of Patent: Dec. 22, 2009

(54) REMOTE CONTROLLER

(75) Inventor: Shingo Hamada, Osaka (JP)

(73) Assignee: Funai Electric Co., Ltd., Osaka (JP)

( * ) Notice: Subject to any disclaimer, the term of this patent is extended or adjusted under 35 U.S.C. 154(b) by 81 days.

(21) Appl. No.: 11/731,934

(22) Filed: Apr. 2, 2007

(65) Prior Publication Data

US 2007/0227872 A1 Oct. 4, 2007

(30) Foreign Application Priority Data

Apr. 3, 2006 (JP) ..... 2006-102584

(51) Int. Cl.
*H01H 13/70* (2006.01)

(52) U.S. Cl. ..... 200/343; 200/345; 200/293

(58) Field of Classification Search ..... 200/341–345, 200/5 A, 4, 329, 17 R, 293, 296, 335; 455/157.2, 455/158.5, 159.1; 400/490, 491, 492
See application file for complete search history.

(56) References Cited

U.S. PATENT DOCUMENTS 5,131,308 A * 7/1992 Katsuta ..... 84/434
5,912,443 A * 6/1999 Hasunuma ..... 200/5 A
6,392,179 B1 * 5/2002 Schwarzbich ..... 200/520
6,433,773 B1 * 8/2002 Hasuda ..... 345/156
6,580,045 B1 * 6/2003 Kuo ..... 200/559
6,914,206 B2 * 7/2005 Mukougawa ..... 200/556

FOREIGN PATENT DOCUMENTS

JP 3-82992 8/1991

* cited by examiner

*Primary Examiner*—Kyung Lee
(74) *Attorney, Agent, or Firm*—Osha • Liang LLP

(57) ABSTRACT

The invention provides a remote controller which can prevent a discordant rattle noise and an operation sound of a button from being generated without deteriorating operability of the button. In a remote controller provided with a board mounting a circuit transmitting a signal for operating an electronic apparatus by remote control, and a tact switch thereon, a button pressing the switch so as to actuate, and a case storing the board and the switch in an inner portion and holding the button so as to freely operate by pressing, the button is provided with a pressing portion, an arm portion and a flange portion, the case is provided with a support portion supporting the arm portion so as to be rotatable vertically to the board, and a hook portion having an elastic force which is weaker than an elastic force of the switch, the arm portion is rotatably supported by the support portion, the pressing portion is supported by the switch from the board side, the flange portion is supported by the hook portion from the case side, and the button is made immovable in a state of swing by a pressing operation so as to be held.

5 Claims, 7 Drawing Sheets

REMOTE CONTROLLER

BACKGROUND OF THE INVENTION

1. Field of the Invention

The present invention relates to a structure for preventing looseness of a button in a remote controller operating an electronic apparatus by remote control.

2. Description of the Related Art

FIG. 6 is an exploded view of a conventional remote controller 50. The remote controller 50 is structured such as to operate a projector or the like corresponding to one example of an electronic apparatus by remote control. Reference numeral 1 denotes a top case, reference numeral 2A denotes a bottom case, and reference numeral 3 denotes a front cover. The top case 1 and the bottom case 2A are formed by injection molding a synthetic resin having no translucency. The front cover 3 is formed by injection molding a synthetic resin having translucency. The top case 1, the bottom case 2A and the front cover 3 are assembled by installing the front cover 3 to a front side of the bottom case 2A and fitting the top case 1 to the bottom case 2A from an upper side. The top case 1 and the bottom case 2A are fixed on the basis of a publicly known lock structure and a screwing structure constituted by a screw 9. The bottom case 2A is provided with a battery storage portion 21 storing batteries (not shown). The battery storage portion 21 is open toward a lower side. Reference numeral 4 denotes a battery lid. The battery lid 4 is formed by injection molding a synthetic resin having no translucency. The battery lid 4 is detachably attached to the bottom case 2A, and opens and closes the battery storage portion 21. Reference numerals 81 to 83 denote a connection piece installed to the battery storage portion 21. The connection pieces 81 to 83 are brought into contact with a plus pole and a minus pole of the batteries stored in the battery storage portion 21.

Reference numeral 5 denotes a button sheet. The button sheet 5 is formed by molding synthetic rubber having translucency. The button sheet 5 is integrally provided with a plurality of operating buttons 51 for operating the projector or the like by remote control. Reference numeral 6 denotes a board. The board 6 is formed by glass epoxy resin or the like. A plurality of contact 61 and LED 62 are mounted on an upper surface of the board 6. Each of the contact 61 is provided in such a manner as to correspond to each of the operating button 51. Each of the LED 62 is a light for lighting each of the operating buttons 51. The button sheet 5 is mounted on an upper surface of the board 6 in such a manner that a lower surface of each of the operating buttons 51 faces to each of the contact 61. The button sheet 5 and the board 6 are stored in an inner portion of the cases 1 and 2A. In the stored state, the board 6 is sandwiched by the cases 1 and 2A from upper and lower sides, and is fixed while being held in a side portion by the bottom case 2A. The button sheet 5 is sandwiched by the top case 1 and the board 6 from the upper end lower sides, and is fixed while being held in the side portion by the cases 1 and 2A. Each of the operating buttons 51 protrudes to an outer portion from each of holes 11 formed in the top case 1, and is operable by pressing with a finger. If each of the operating buttons 51 is pressed to operate, the button 51 presses the corresponding contact 61, and the contact 61 comes to an ON state (a conductive state).

A light 63, a light emitting diode 64, a tact switch 65 and connection pieces 82 and 83 are mounted on a lower surface of the board 6. The light 63 protrudes to an outer portion from a hole 31 formed in the front cover 3 so as to illuminate a forward side. The light emitting diode 64 transmits a signal of an infrared ray to a receiving portion provided in a main body of the projector or the like (not shown). The front cover 3 transmits the infrared ray of the light emitting diode 64. The tact switch 65 corresponds to one example of a press-in type switch, and actuates the LED 62. An electric power of the batteries stored in the battery storage portion 21 is supplied to the board 6 via the connection pieces 81 to 83. In each of layers of the board 6, there are mounted a circuit for transmitting an operation signal of the projector or the like corresponding to each of the operating buttons 51 from the light emitting diode 64 at a time of an ON state of each of the contact 61, a circuit for turning on the LED 62 at a time of the ON state of the tact switch 65, a circuit for turning on the light 63 at a time of the ON state of the predetermined contact 61, a circuit for supplying the electric power of the batteries to each of the portions of the board 6 and the like (each of which is not shown).

Reference numeral 7A denotes a lighting button for turning on the LED 62 by pressing the tact switch 65. The lighting button 7A is formed by injection molding synthetic resin having no translucency. The lighting button 7A is held by the bottom case 2A between the board 6 and the bottom case 2A, protrudes to an outer portion from a hole 22 formed in the bottom case 2A, and can be operated by pressing with a finger. The lighting button 7A and the hole 22 are provided in an opposite side to the operating button 51, and are arranged at positions of the bottom case 2A with which any finger of a hand is in contact at a time of gripping the cases 1 and 2A by the hand in a used mode, that is, at a time of gripping the cases 1 and 2A by the hand in such a manner as to operate the operating button 51 with the finger.

FIG. 7 is a cross sectional view showing a portion near the lighting button 7A in a state in which the remote controller 50 is assembled. An operating portion 71 operated by pressing with a finger is integrally provided in the bottom case 2A side of a center portion of the lightening button 7A. A pressing portion 72 pressing a movable portion 66 of the tact switch 65 is integrally provided in an inner side of the center portion of the lighting button 7A. An inner portion of the tact switch 65 is provided with a contact which comes to an ON state (a conductive state) by the movable portion 66 being pressed, and a spring protruding the movable portion 66 by a predetermined elastic force (each of which is not shown). Two arm portions 73 are integrally provided in an end portion in a rear side of the lighting button 7A. A shaft portion 74 protruding to an outer side as shown in FIG. 6 is integrally provided in a tip of each of the arm portions 73. A support portion 23 is integrally provided at a position facing to each of the arm portions 73 of the bottom case 2A as shown in FIG. 7. A shaft hole 24 fitting each of the shaft portions 74 thereto is formed in each of the support portions 23. Each of the support portions 23 rotatably supports each of the shaft portions 74 fitted to each of the shaft holes 24 by an edge of each of the shaft holes 24 so as to be vertically rotatable with respect to the board 6. The lighting button 7A is rotatably supported in each of the arm portions 73 by each of the support portions 23, and is supported in the pressing portion 72 from the board 6 side by the tact switch 65, thereby being held in a state in which the operating portion 71 is protruded to the outer portion from the hole 22 of the bottom case 2A.

If the operating portion 71 of the lighting button 7A is operated by pressing to the board 6 side with the finger, the lighting button 7A is rotated in a direction moving close to the board 6 around the shaft portion 74 so as to be swung, and the pressing portion 72 compresses the movable portion 66 of the tact switch 65. Accordingly, the contact in the inner portion of the tact switch 65 comes to the ON state, the LED 62 on the upper surface of the board 6 is turned on, and each of the operating buttons 51 is illuminated. Thereafter, if the pressing operation of the operating portion 71 is cancelled, the movable portion 66 of the tact switch 65 is protruded by an elastic force of the spring in the inner portion, and presses the pressing portion 72 to the bottom case 2A side, the lighting button 7A is rotated in a direction moving away from the board 6 around the shaft portion 74 so as to be swung, and the operating portion 71 is protruded from the hole 22. Accordingly, the contact in the inner portion of the tact switch 65 comes to an OFF state, the LED 62 is turned off, and each of the operating buttons 51 is not illuminated.

In order to make the lighting button 7A freely swing as mentioned above, gaps Sa and Sb forming an allowance as shown in FIG. 7 are provided between the lighting button 7A and the bottom case 2A and the board 6. However, if the gaps Sa and Sb are provided as mentioned above, the lighting button 7A becomes shaky between the bottom case 2A and the board 6 and comes into collision with the bottom case 2A and the tact switch 65 at a time when the remote controller 50 is gripped by the hand so as to be swung, whereby a discordant noise is generated. In order to prevent this, there can be considered to make the gaps Sa and Sb extremely small. However, in this case, in the case that the tact switch 65 is mounted to the board 6 in a floating state, the movable portion 66 of the tact switch 65 comes to a state of being always pressed by the pressing portion 72, thereby deteriorating operability such as an operating amount of the lighting button 7A is reduced.

On the other hand, Japanese Unexamined Utility Model Publication No. 3-82992 discloses a remote controller in which a side button pressing a push switch is arranged in a side surface of a case so as to be spaced from the push switch, a hinge-shaped rib is provided in the side button itself or in a button sheet having a plurality of operating buttons arranged within the case, and one end portion of the side buttons is pressed to an inner surface of the case by the rib so as to be held in an operable manner. However, in accordance with this structure, when the side button is pressed to operate, the side button comes into collision with the push switch, and the discordant noise is generated. Further, when the operation is cancelled, the side button comes into collision with the case on the basis of the elastic force of the rib, and there is a case that the discordant noise is generated.

SUMMARY OF THE INVENTION

The present invention solves the problem mentioned above, and an object of the present invention is to provide a remote controller which can prevent a discordant rattle noise and an operation sound of a button from being generated without deteriorating operability of the button.

In accordance with the present invention, there is provided a remote controller comprising:

a circuit transmitting a signal for operating an electronic apparatus by remote control;

a press-in type switch;

a board mounting the circuit and the switch thereon;

a button pressing the switch so as to actuate; and a case storing the board and the switch in an inner portion and holding the button so as to freely press to operate, wherein the case is provided with a support portion supporting the button so as to be movable in a direction moving close to the board or a direction moving away from the board, and an elastic portion having an elastic force which is weaker than an elastic force of the switch, and the button is movably supported by the support portion, is supported by the switch from the board side, is supported by the elastic portion from an opposite side to the board, and is made immovable in operable state by pressing so as to be held.

As mentioned above, if the button is made immovable in the operable state by pressing, that is, in a state of being spaced from the case and the board so as to be held by the support portion and the elastic portion of the case and the switch, it is possible to suppress the movement of the button in the other directions than the direction of moving close to the board and the direction of moving away from the board by the support portion at a time when the button is not operated, and it is possible to suppress the movement of the button in the direction of moving close to the board and in the direction of moving away from the board by the switch and the elastic portion. Accordingly, it is possible to eliminate the looseness of the button generated at a time when the case is shaken. Further, since the button and the switch are always in contact with each other but are not spaced, it is possible to prevent the button from coming into collision with the switch at a time of pressing the button and at a time of canceling the operation. Since a positional relation between the supporting point of the button by the switch and the supporting point of the case by the elastic portion is changed by a design or a dimensional error after being assembled, the button and the elastic portion are always in contact with each other so as to be prevented from being spaced, or are spaced only at a time of pressing the button. Therefore, in the case that the button and the elastic portion are always in contact so as to be prevented from being spaced, it is possible to prevent the button from coming into collision with the elastic portion at a time of canceling the pressing operation of the button, and in the case that the button and the elastic portion are spaced only at a time of pressing the button, it is possible to buffer the collision of the button by the elastic portion at a time of canceling the pressing operation of the button. Further, since the elastic force of the elastic portion of the case is weaker than the elastic force of the switch, in the case that the switch is mounted to the board in the floating state, the elastic portion is deformed at the floating degree, thereby preventing the switch from coming to the state in which the switch is always pressed in by the button, and it is possible to secure a predetermined operating amount of the button. Accordingly, it is possible to prevent the discordant rattle noise and the operating sound of the button from being generated without deteriorating operability of the button. Further, since the support portion and the elastic portion are provided in the case which is larger in size than the button and the other parts and is constituted by a fixed body, in place of the button corresponding to the movable body and the other small-sized parts arranged in the inner portion of the case, it is possible to easily design and install the support portion and the elastic portion so as to achieve the elastic force of the elastic portion approximately in accordance with the design.

In accordance with one embodiment of the present invention, in the structure mentioned above, the support portion and the elastic portion are integrally provided in the case.

According to this structure, the support portion and the elastic portion are easily provided in the case by modifying a forming metal mold of the existing case, the number of the parts is reduced in comparison with the case that the support portion and the elastic portion are manufactured independently from the case, and it is possible to suppress the cost.

Further, in accordance with one embodiment of the present invention, in the structure mentioned above, the switch is arranged at a position of the board facing to the button, a pressing portion pressing the switch is provided in a center portion of the button, a first protruding portion protruding to an opposite side to the switch is provided in one end portion of the button, a second protruding portion protruding to an opposite side to the first protruding portion and the switch is provided in the other end portion in an opposite side to the one end portion of the button, a tip of the first protruding portion is supported by the support portion of the case so as to be vertically rotatable with respect to the board, the pressing portion is supported by the switch from the board side, the second protruding portion is supported by the elastic portion of the case from an opposite side to the board, the button is made immovable so as to be held in a state of being freely swung by the pressing operation, the supporting point of the first protruding portion by the support portion is moved away from the supporting point of the pressing portion by the switch, and the supporting point of the second protruding portion by the elastic portion is moved close to the supporting point of the pressing portion by the switch.

According to the structure mentioned above, since the first protruding portion and the support portion are provided in one end portion of the button and at the position of the case in the side portion thereof, and the second protruding portion and the elastic portion are provided in the other end portion of the button in the opposite side and the position of the case in the side portion thereof, an installing space becomes wider, a design freedom becomes higher and it is possible to easily design and install each of the portions so as to achieve a function of each of the portions approximately in accordance with the design, in comparison with the case that each of the portions is provided at the position at which the center portion of the button faces to the case. Further, it is possible to elongate an operating stroke at a time of pressing the button so as to improve operability, by moving the supporting point rotatably supporting the first protruding portion of the button by the support portion of the case as away as possible from the supporting point supporting the pressing portion by the switch from the board side. Further, it is possible to make a difference of displacement in the elastic portion and the switch at a time of pressing the button smaller so as to easily secure an equilibrium and a balance of the elastic force between the elastic portion and the switch, by moving the supporting point supporting the second protruding portion of the button by the elastic portion of the case from the opposite side to the board as close as possible to the supporting point supporting the pressing portion by the switch from the board side. Accordingly, it is possible to smoothly rotate the button around the tip of the first protruding portion so as to swing, and it is possible to improve operability.

Further, in accordance with one embodiment of the present invention, in the structure mentioned above, the pressing portion, the first support portion and the second support portion are integrally provided in the button.

According to the structure mentioned above, the pressing portion, the first support portion and the second support portion can be easily provided in the button by modifying the forming metal mold of the existing button or the like, and it is possible to reduce the number of the parts, and suppress the cost, in comparison with the case that the pressing portion, the first support portion and the second support portion are provided independently from the button.

Further, in accordance with a typical embodiment of the present invention, there is provided a remote controller comprising:

a plurality of operating buttons operating an electronic apparatus by remote control;

a circuit transmitting a signal corresponding to each of the operating buttons;

a light lighting each of the operating buttons;

a tact switch actuating the light;

a lighting button pressing the tact switch so as to turn on the light;

a board mounting the circuit, the light and the tact switch thereon;

a case storing the board in an inner portion and holding the operating button and the lighting button so as to protrude to an outer portion in such a manner as to be operable by pressing; and the lighting button being arranged at a position with which a finger is in contact at a time of gripping the case by a hand in a used mode in an opposite side of the case to the operating button, wherein the tact switch is arranged at a facing position of the board to the lighting button, a pressing portion pressing the tact switch is integrally provided in a center portion of the lighting button, an arm portion protruding to an opposite side to the tact switch is integrally provided in one end portion of the lighting button, a flange portion protruding to an opposite side to the arm portion and the tact switch is integrally provided in the other end portion in an opposite side to the one end portion of the lighting button, a support portion rotatably supporting a tip of the arm portion so as to be vertically rotatable with respect to the board is integrally provided at a position of the case facing to the arm portion, a hook portion having a weaker elastic force than the tact switch is integrally provided at a position of the case facing to the flange portion, the arm portion is rotatably supported by the support portion, the pressing portion is supported by the tact switch from the board side, the flange portion is supported by the hook portion from an opposite side to the board, the lighting button is made immovable in a state of freely swing by a pressing operation so as to be held, the supporting point of the arm portion by the support portion is moved away from the supporting point of the pressing portion by the tact switch, and the supporting point of the flange portion by the hook portion is moved close to the supporting point of the pressing portion by the tact switch.

According to this structure, since it is possible to suppress the swing in the other directions than the direction in which the lighting button moves close to the board and the direction in which the lighting button moves away from the board, and it is possible to suppress the swing in the direction in which the lighting button moves close to the board and the direction in which the lighting button moves away from the board, by the tact switch and the hook portion of the case, at a time when the lighting button is not operated, it is possible to eliminate the shake of the lighting button at a time when the case is shaken. Further, since the lighting button and the tact switch are always in contact so as to be prevented from being spaced, it is possible to prevent the lighting button from coming into collision with the tact switch at a time of the pressing operation of the lighting button or at a time of canceling the operation. Further, in the case that the lighting button and the hook portion of the case become always in contact so as to become prevented from being spaced, it is possible to prevent the lighting button from coming into collision with the hook portion at a time of canceling the pressing operation of the lightning button. Further, in the case that the lighting button and the hook portion of the case become spaced only at a time of the pressing operation of the lighting button, it is possible to buffer the collision of the lighting button by the hook portion at a time of canceling the pressing operation of the lighting button. Further, since the elastic force of the hook portion of the case is weaker than the elastic force of the tact switch, in the case that the tact switch is mounted to the board in the floating state, the hook portion is deformed at the floating degree. Hence, it is possible to prevent the tact switch from coming to the state in which the tact switch is always pressed in by the lighting button, and it is possible to secure a predetermined operating amount of the lighting button. Accordingly, it is possible to prevent the discordant rattle noise and the operating sound of the lighting button from being generated without deteriorating operability of the lighting button. Further, since the arm portion and the flange portion are integrally provided in both end portions of the lighting button corresponding to the movable body, and the support portion and the hook portion are integrally provided in the case corresponding to the large-sized fixed body, an installing space becomes wider, a design freedom becomes higher, a number of the parts is reduced, and it is possible to easily design and install each of the portions at a low cost so as to achieve a function of each of the portions approximately in accordance with the design. Further, it is possible to elongate an operating stroke at a time of the pressing operation of the lighting button, by moving the supporting point of the arm portion by the support portion away from the supporting point of the pressing portion by the tact switch and moving the supporting point of the flange portion by the hook portion to the supporting point of the pressing portion by the tact switch, and it is possible to make a difference of displacement in the hook portion and the tact switch small so as to easily secure an equilibrium and a balance of the force. Accordingly, it is possible to smoothly rotate the lighting button around the tip of the arm portion so as to swing, and it is possible to improve operability.

In accordance with the present invention, it is possible to prevent the looseness of the button at a time when the case is shaken, it is possible to prevent or buffer the collision of the button with the switch or the case at a time of the pressing operation of the button or at a time of canceling the operation, and it is possible to prevent the switch from being always pressed in so as to secure the operating amount of the button, it is possible to prevent the discordant rattle noise and the operating sound of the button from being generated without deteriorating operability of the button.

DESCRIPTION OF THE PREFERRED EMBODIMENT

Figure 1:
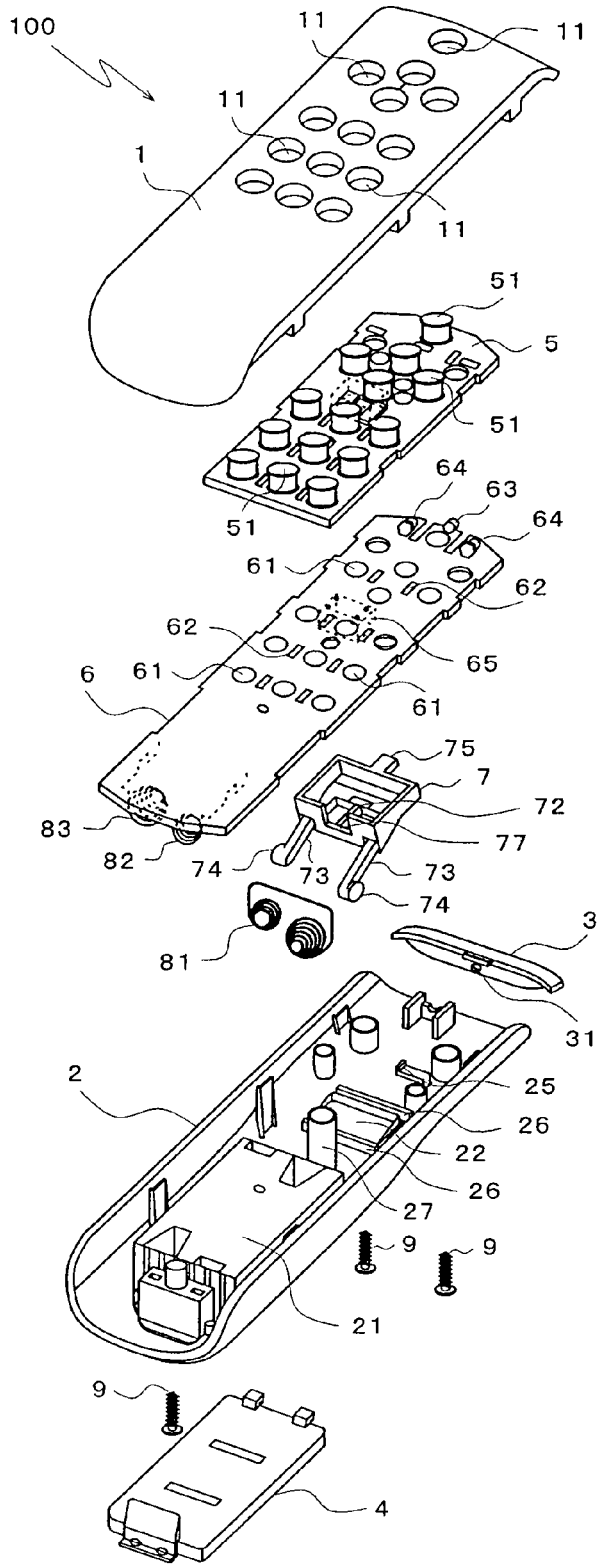
FIG. 1 is an exploded view of a remote controller in accordance with an embodiment of the present invention.
Figure 6:
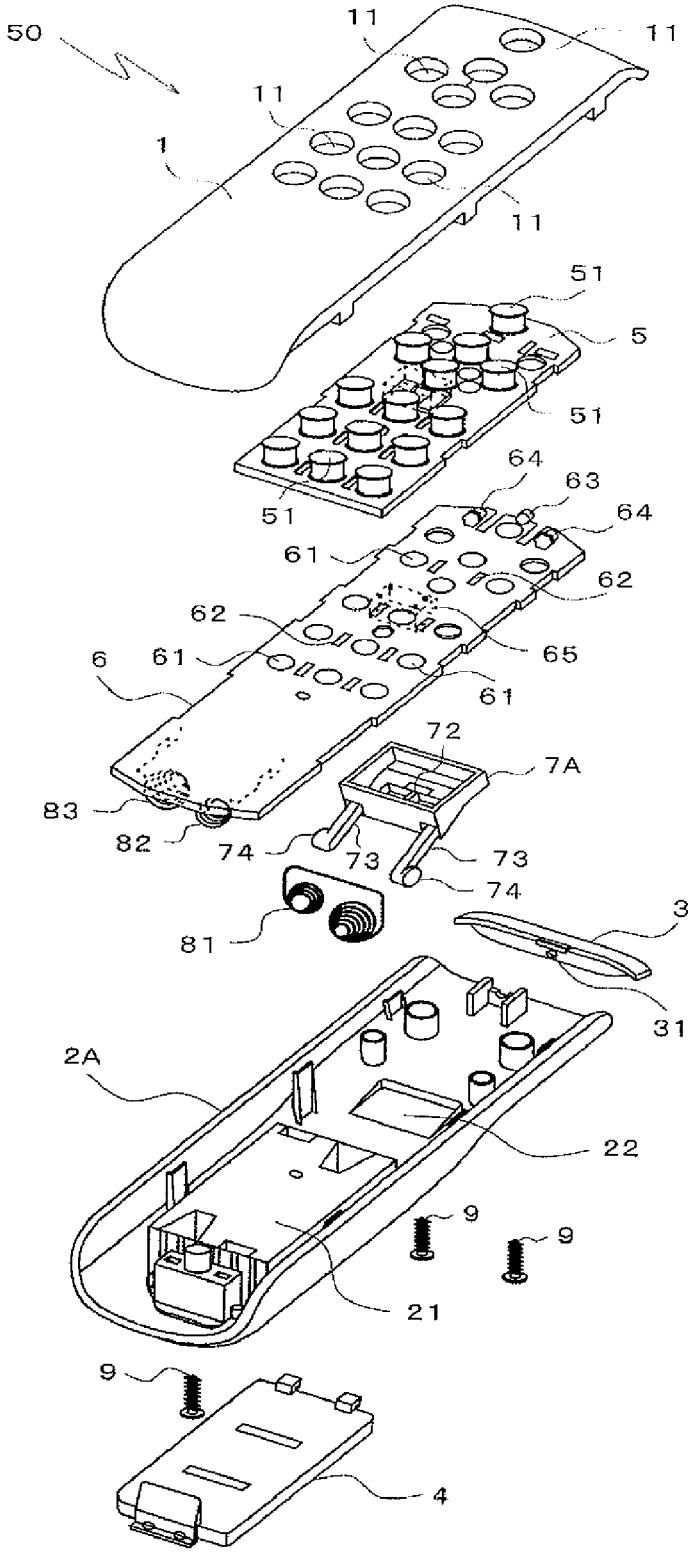
FIG. 6 CONVENTIONAL ART
FIG. 6 is an exploded view of a conventional remote controller.
Figure 7:
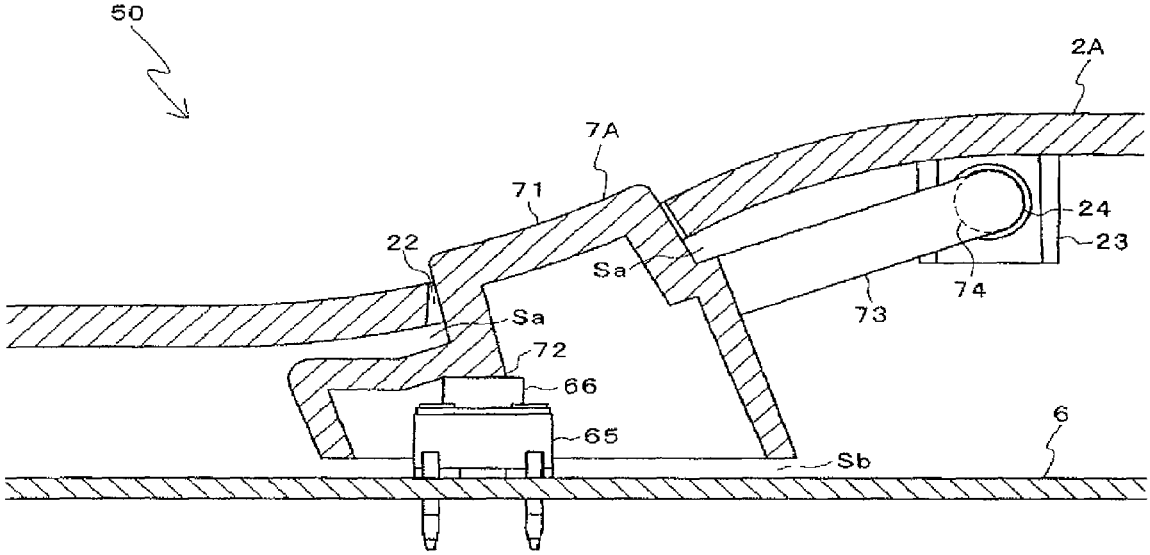
FIG. 7 CONVENTIONAL ART
FIG. 7 is a cross sectional view near lighting button of the remote controller.

FIG. 1 is an exploded view of a remote controller 100 in accordance with an embodiment of the present invention. The remote controller 100 is structured such as to operate an electronic apparatus 200 (FIG. 2) such as a projector or the like by remote control. The remote controller 100 is different from the conventional remote controller 50 shown in FIGS. 6 and 7, in a point that a bottom case 2 and a lighting button 7 are used in place of the bottom case 2A and the lighting button 7A. Accordingly, the same reference numerals are attached to the same portions as those of FIGS. 6 and 7 and the corresponding portions thereto as a matter of convenience, and an overlapping description will be omitted.

The bottom case 2 is formed by injection molding synthetic resin having no translucency. A top case 1, the bottom case 2 and a front cover 3 are assembled by installing the front cover 3 to a front side of the bottom case 2, and fitting the top case 1 to the bottom case 2 from an upper side. The top case 1 and the bottom case 2 are fixed on the basis of a publicly known lock structure and a screwing structure constituted by a screw 9. The bottom case 2 is provided with a battery storage portion 21 so as to be open toward a lower side. A battery lid 4 is detachably attached to the bottom case 2, and opens and closes the battery storage portion 21. Connection pieces 81 to 83 are installed to the battery storage portion 21 and are brought into contact with a plus pole and a minus pole of batteries (not shown) stored in the battery storage portion 21.

A button sheet 5 is integrally provided with a plurality of operating buttons 51 for operating the electronic apparatus by remote control. On an upper surface of a board 6, there are mounted a plurality of contact 61 corresponding to the respective operating buttons 51, and a plurality of LED 62 serving as a light for illuminating the respective operating buttons 51. The button sheet 5 and the board 6 are stored in an inner portion of the cases 1 and 2. The board 6 is sandwiched by the cases 1 and 2 from upper and lower sides, and is fixed while being held in a side portion by the bottom case 2. The button sheet 5 is sandwiched by the top case 1 and the board 6 from the upper end lower sides, and is fixed while being held in the side portion by the cases 1 and 2. Each of the operating buttons 51 protrudes to an outer portion from each of holes 11 formed in the top case 1, and is operable by pressing with a finger. When each of the operating buttons 51 is pressed to operate, the button 51 presses the corresponding contact 61, and the contact 61 comes to an ON state (a conductive state).

Figure 2:
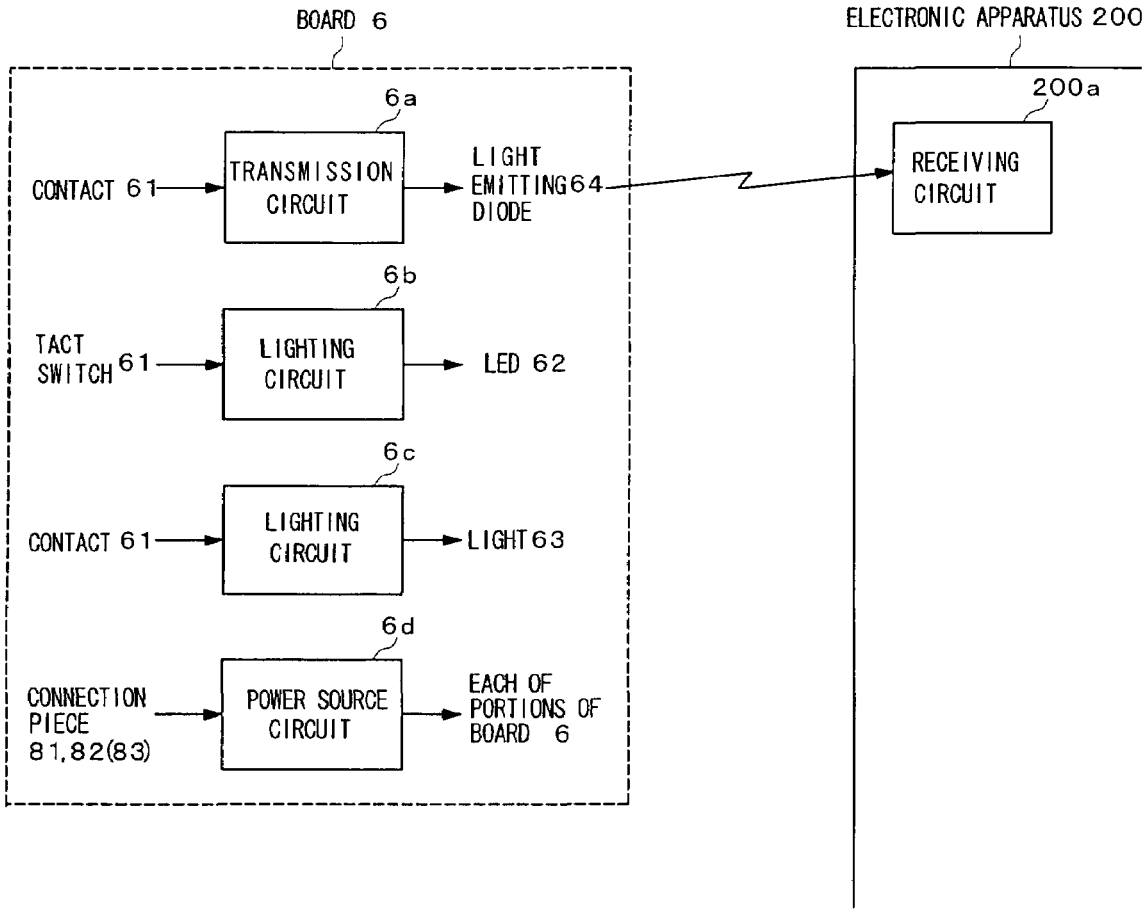
FIG. 2 is a view showing an electric circuit of a board of the remote controller.

In a lower surface of the board 6, there are mounted a light 63 illuminating a forward side, a light emitting diode 64 transmitting a signal of an infrared ray to a main body of the projector or the like (not shown), a tact switch 65 corresponding to one example of a press-in type switch actuating the LED 62, and connection pieces 82 and 83. An electric circuit is mounted to each of layers of the board 6. FIG. 2 is a view showing a structure of the electric circuit of the board 6. On the board 6, there are mounted a transmission circuit 6*a*, lighting circuits 6*b* and 6*c*, a power source circuit 6*d*, and the like. The transmission circuit 6*a* transmits an operation signal of the electronic apparatus 200 corresponding to each of the contact 61 and each of the operating buttons 51 from the light emitting diode 64 at a time of an ON state of each of the contact 61. The operation signal transmitted from the light emitting diode 64 is received by a receiving circuit 200*a* provided in the electronic apparatus 200. The lighting circuit 6*b* turns on the LED 62 at a time of the ON state of the tact switch 65. The lighting circuit 6*c* turns on the light 63 at a time of the ON state of the predetermined contact 61. The power source circuit 6*d* supplies the electric power of the batteries to each of the portions of the board 6 via the connection pieces 81 to 83.

A lighting button 7 in FIG. 1 is a button for turning on the LED 62 by pressing the tact switch 65. The lighting button 7 is formed by injection molding synthetic resin having no translucency. The lighting button 7 is held by the bottom case 2 between the board 6 and the bottom case 2, protrudes to an outer portion from a hole 22 formed in the bottom case 2, and can be pressed to operate with a finger. The lighting button 7 and the hole 22 are provided in an opposite side to the operating button 51, and are arranged at positions of the bottom case 2 with which any finger of a hand is in contact at a time of gripping the cases 1 and 2 by the hand in a used mode, that is, at a time of gripping the cases 1 and 2 by the hand in such a manner as to operate the operating button 51 with the finger.

Figure 3:
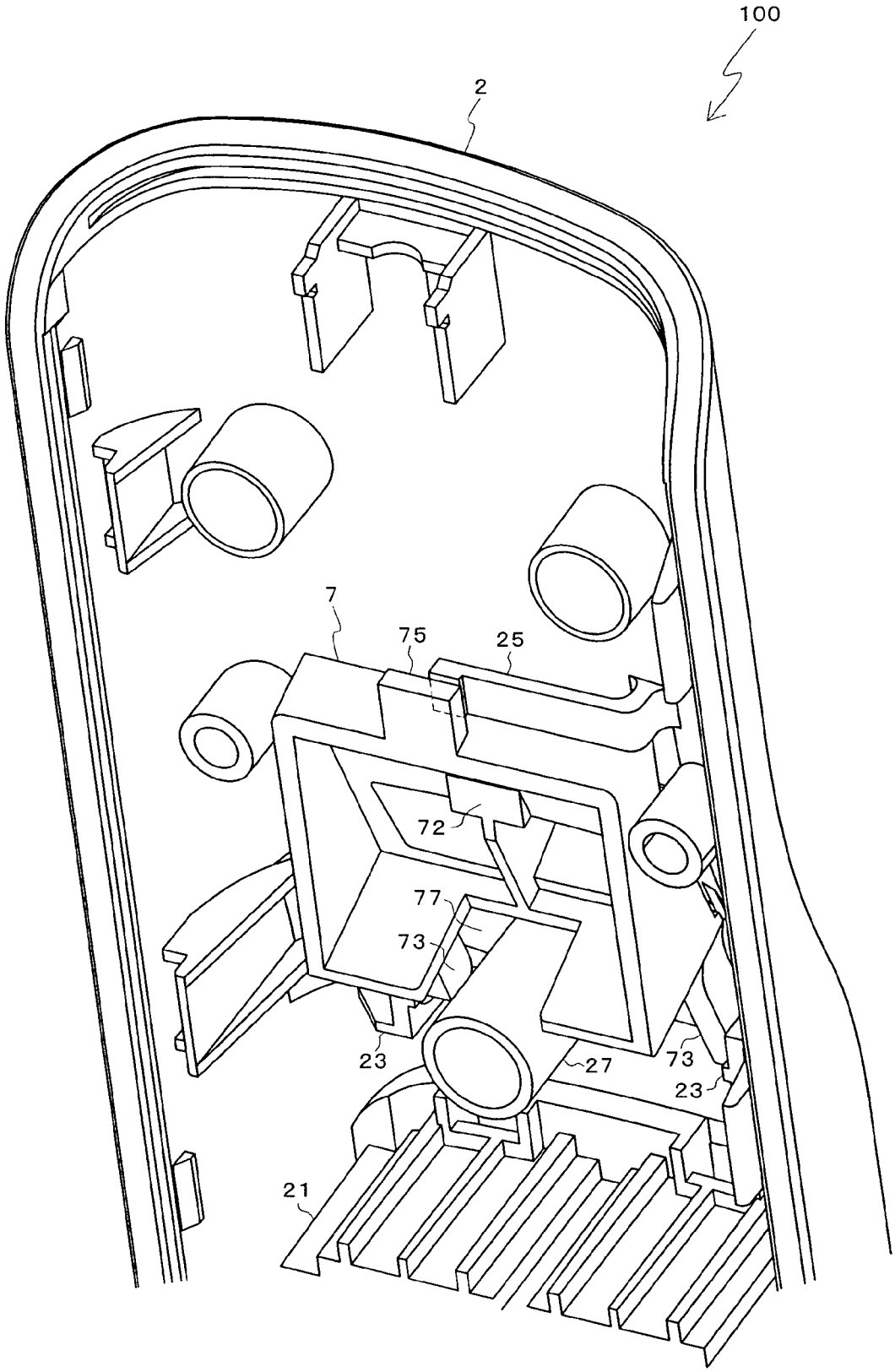
FIG. 3 is a perspective view near a lighting button of the remote controller.
Figure 4:
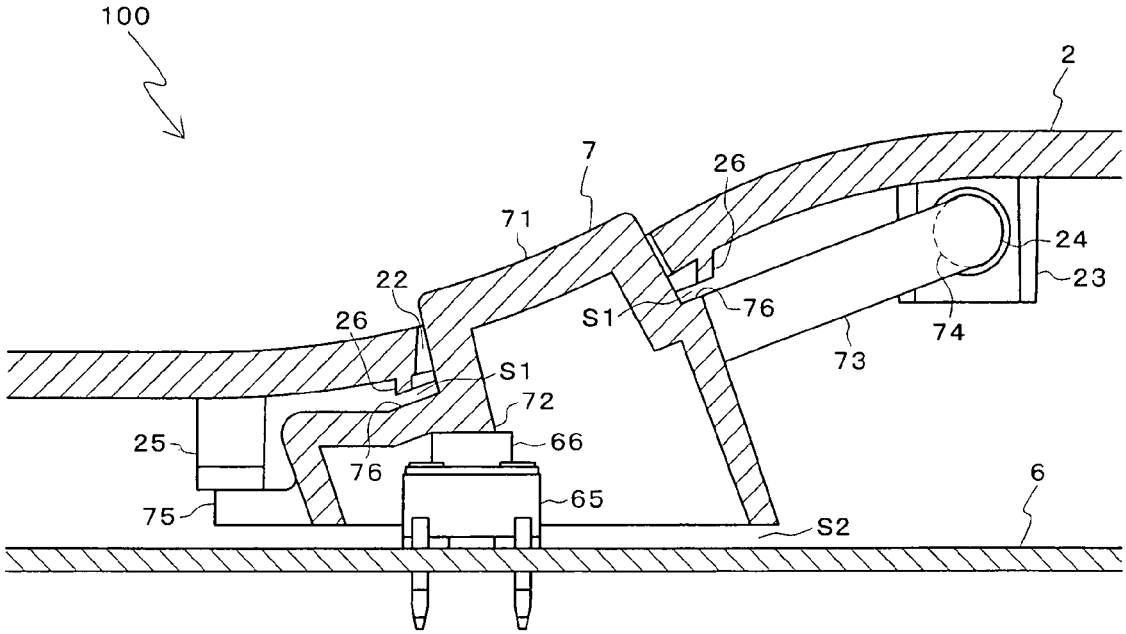
FIG. 4 is a cross sectional view near the lighting button of the remote controller.

FIG. 3 is a perspective view showing a portion near the lighting button 7 in a state in which the remote controller 100 is assembled. FIG. 4 is a cross sectional view showing a portion near the lighting button 7 in the state in which the remote controller is assembled. An operating portion 71 operated by pressing with a finger as shown in FIG. 4 is integrally provided in the bottom case 2 side of a center portion of the lightening button 7 so as to have a slightly smaller diameter than the hole 22 of the bottom case 2. A pressing portion 72 pressing a movable portion 66 of the tact switch 65 is integrally provided in an inner side of the center portion of the lighting button 7. An inner portion of the tact switch 65 is provided with a contact which comes to an ON state (a conductive state) by the movable portion 66 being pressed, and a spring protruding the movable portion 66 by a predetermined elastic force (each of which is not shown). Two arm portions 73 are integrally provided in an end portion in a rear side (a left lower side in FIG. 1, a lower side in FIG. 3 and a right side in FIG. 4) of the lighting button 7 so as to protrude to an opposite side to the tact switch 65. The arm portion 73 corresponds to one embodiment of the first protruding portion. A shaft portion 74 protruding to an outer side in parallel to a short side direction of the bottom case 2 is integrally provided in a tip of each of the arm portions 73 as shown in FIG. 1. A support portion 23 is integrally provided at a position facing to each of the arm portions 73 of the bottom case 2 as shown in FIG. 4. A shaft hole 24 fitting each of the shaft portions 74 thereto is formed in each of the support portions 23. Each of the support portions 23 rotatably supports each of the shaft portions 74 fitted to each of the shaft holes 24 by an edge of each of the shaft holes 24 so as to be vertically rotatable with respect to the board 6.

A flange portion 75 is integrally provided in an end portion in a front side (a right upper side in FIG. 1, an upper side in FIG. 3 and a left side in FIG. 4) of the lighting button 7 so as to protrude to an opposite side to the arm portion 73 and the tact switch 65. The flange portion 75 corresponds to one embodiment of the second protruding portion. An bent hook portion 25 is integrally provided as shown in FIGS. 3 and 4, at a position of the bottom case 2 facing to the flange portion 75. The hook portion 25 has a weaker elastic force than the spring in the inner portion of the tact switch 65. The hook portion 25 corresponds to one embodiment of the elastic portion. As shown in FIG. 4, the lighting button 7 is immovable and held in a state in which the lighting button 7 is rotated around the shaft portion 74 by the pressing operation so as to freely swing in the direction of moving close to the board 6 or the direction of moving away from the board 6, that is, a state in which the operating portion 71 is protruded to the outer portion from the hole 22 of the bottom case 2 and is spaced from the inner surface of the bottom case 2 and the upper surface of the board 6, by rotatably supporting each of the arm portions 73 of the lighting button 7 by each of the support portions 23 of the bottom case 2, supporting the pressing portion 72 of the lighting button 7 by the movable portion 66 of the tact switch 65 from the board 6 side, and supporting the flange portion 75 of the lighting button 7 by the hook portion 25 of the bottom case 2 from the opposite side (the bottom case 2 side) to the board 6. The tact switch 65, each of the portions 23 to 25 of the bottom case 2, and each of the portions 72 to 75 of the lighting button 7 are respectively arranged in such a manner as to move the supporting point of the arm portion 73 by the support portion 23 as far as possible from the supporting point of the pressing portion 72 by the tact switch 65, and move the supporting point of the flange portion 75 by the hook portion 25 as close as possible to the supporting point of the pressing portion 72 by the tact switch 65, within a range which does not form an obstacle to the layout of the other parts in the inner portion of the cases 1 and 2.

A wall 26 having a predetermined height is integrally provided in front and rear sides of the hole 22 of the inner surface of the bottom case 2. It is possible to limit an excessive swing of the lighting button 7 in the direction of moving away from the board 6 on the basis of a collision of a step portion 76 of the lighting button 7 with the wall 26. A tube 27 is integrally provided between the wall 26 and the support portion 23 of the bottom case 2, as shown in FIGS. 1 and 3. A notch 77 is provided in an end portion in a rear side of the lighting button 7. It is possible to limit an excessive swing of the lighting button 7 in the direction of moving close to the board 6 on the basis of a collision of an edge in the pressing portion 72 side of the notch 77 with the peripheral surface of the tube portion 27. As shown in FIG. 4, gaps S1 and S2 forming an allowance for freely swinging the lighting button 7 are provided among the lighting button 7, the bottom case 2 and the board 6. A size of the gaps S1 and S2 is set such a size that the step portion 76 of the lighting button 7 and the wall 26 of the bottom case 2 are not in contact with each other even in the case that the tact switch 65 is mounted in a state in which the tact switch 65 floats at a predetermined height from the board 6 in accordance with a soldering or the like.

In the case of pressing the operating portion 71 of the lighting button 7 to the board 6 side with the finger, the lighting button 7 is rotated and swung around the shaft portion 74 in the direction of moving close to the board 6, and the pressing portion 72 presses in the movable portion 66 of the tact switch 65. Accordingly, the contact in the inner portion of the tact switch 65 comes to an ON state, the LED 62 on the upper surface of the board 6 is turned on, each of the operating buttons 51 is illuminated, and it is possible to easily operate even in the dark. Thereafter, in the case of canceling the pressing operation mentioned above of the operating portion 71, that is, in the case of releasing the finger from the operating portion 71, the movable portion 66 of the tact switch 65 protrudes on the basis of the elastic force of the spring in the inner portion so as to press the pressing portion 72 to the bottom case 2 side, the lighting button 7 is rotated and swung around the shaft portion 74 in the direction of moving away from the board 6, and the operating portion 71 protrudes from the hole 22. Then, the contact in the inner portion of the tact switch 65 comes to an OFF state, the LED 62 is turned off, and each of the operating buttons 51 is not illuminated.

In accordance with the structure mentioned above, the arm portion 73, the flange portion 75 and the pressing portion 72 corresponding to the rigid body of the lighting button 7 come to the freely rotating and swinging state on the basis of the pressing operation of the support portion 23 of the bottom case 2 corresponding to the rigid body, the hook portion 25 of the bottom case 2 corresponding to the elastic body, and the movable portion 66 of the tact switch 65 corresponding to the elastic body, that is, are held while being immovable in the state of being spaced from the bottom case 2 and the board 6. Accordingly, since it is possible to suppress the swing in the other directions than the direction in which the lighting button 7 moves close to the board 6 and the direction in which the lighting button 7 moves away from the board 6, by the support portion 23, and it is possible to suppress the swing in the direction in which the lighting button 7 moves close to the board 6 and the direction in which the lighting button 7 moves away from the board 6, by the movable portion 66 of the tact switch 65 and the hook portion 25, at a time when the lighting button 7 is not operated, it is possible to eliminate the looseness of the lighting button 7 at a time when the cases 1 and 2 are gripped by the hand so as to be shaken. Further, since the pressing portion 72 of the lighting button 7 and the movable portion 66 of the tact switch 65 are always in contact with each other so as to be prevented from being spaced, it is possible to prevent the pressing portion 72 from coming into collision with the movable portion 66 at a time of pressing the lighting button 7 or at a time of canceling the operation. Further, a positional relation between the supporting point of the pressing portion 72 by the movable portion 66 of the tact switch 65 and the supporting point of the flange portion 75 by the hook portion 25 is changed by a design or a dimensional error after being assembled, the flange portion 75 and the hook portion 25 are always in contact with each other so as to be prevented from being spaced, or are spaced only at a time of pressing the lighting button 7. Therefore, in the case that the flange portion 75 and the hook portion 25 are always in contact so as to be prevented from being spaced, it is possible to prevent the flange portion 75 from coming into collision with the hook portion 25 at a time of canceling the pressing operation of the lighting button 7, and in the case that the flange portion 75 and the hook portion 25 are spaced only at a time of pressing the lighting button 7, it is possible to buffer the collision of the flange portion 75 by the hook portion 25 at a time of canceling the pressing operation of the lighting button 7. Further, since the elastic force of the hook portion 25 is weaker than the elastic force of the spring in the inner portion of the tact switch 65, in the case that the tact switch 65 is mounted to the board 6 in the floating state, the hook portion 25 is deformed at the floating degree, thereby preventing the movable portion 66 of the tact switch 65 from coming to the state in which the movable portion 66 is always pressed in by the pressing portion 72, and it is possible to secure a predetermined operating amount of the lighting button 7. Accordingly, it is possible to prevent the discordant rattle noise and the operating sound of the lighting button 7 from being generated without deteriorating operability of the lighting button 7.

Further, since the support portion 23 and the hook portion 25 are provided in the bottom case 2 which is larger in size than the lighting button 7 and the other parts and is constituted by the fixed body, in place of the lighting button 7 corresponding to the movable body and the other small-sized parts arranged in the inner portion of the bottom case 2, it is possible to easily design and install the support portion 23 and the hook portion 25 so as to achieve the elastic force of the hook portion 25 approximately in accordance with the design. Further, since the support portion 23 and the hook portion 25 are integrally provided in the bottom case 2, the support portion 23 and the hook portion 25 can be easily provided in the bottom case 2 by modifying the forming metal mold of the existing bottom case (for example, by adding a forming part of the hook portion 25 to the forming metal mold of the conventional bottom case 2A shown in FIG. 6 or the like) or the like, and it is possible to reduce the number of the parts, and suppress the cost, in comparison with the case of manufacturing and providing the support portion 23 and the hook portion 25 independently from the bottom case 2.

Further, since the arm portion 73 and the support portion 23 are provided at the end portion in one side (the rear side) of the lighting button 7 and the position of the bottom case 2 in the side portion thereof, and the flange portion 75 and the hook portion 25 are provided at the end portion in the other side (the front side) of the opposite side lighting button 7 and the position of the bottom case 2 in the side portion thereof, an installing space becomes wider, a design freedom becomes higher and it is possible to easily design and install each of the portions 73, 23, 75 and 25 so as to achieve a function of each of the portions 73, 23, 75 and 25 approximately in accordance with the design, in comparison with the case that each of the portions 73, 23, 75 and 25 is provided at the position at which the center portion of the lighting button 7 faces to the bottom case 2. Further, it is possible to elongate an operating stroke at a time of pressing the lighting button 7 so as to improve operability, by moving the supporting point rotatably supporting the arm portion 73 by the support portion 23 as away as possible from the supporting point supporting the pressing portion 72 by the movable portion 66 of the tact switch 65 from the board 6 side. Further, it is possible to make a difference of displacement in the hook portion 25 and the movable portion 66 of the tact switch 65 at a time of pressing the lighting button 7 small so as to easily secure an equilibrium and a balance of the elastic force between the hook portion 25 and the spring in the inner portion of the tact switch 65, by moving the supporting point supporting the flange portion 75 by the hook portion 25 from the opposite side to the board 6 as close as possible to the supporting point supporting the pressing portion 72 by the movable portion 66 of the tact switch 65 from the board 6 side. Accordingly, it is possible to smoothly rotate the lighting button 7 around the shaft portion 74 so as to swing, and it is possible to improve operability. Further, since the pressing portion 72, the arm portion 73, the shaft portion 74 and the flange portion 75 are integrally provided in the lighting button 7, it is possible to easily install each of the portions 72 to 75 mentioned above in the lighting button 7 by modifying the forming metal mold of the existing lighting button (for example, adding the forming part of the flange portion 75 to the forming metal mold of the lighting button 7A shown in FIG. 6 or the like) or the like, and it is possible to reduce the number of the parts, and suppress the cost, in comparison with the case of manufacturing each of the portions 72 to 75 independently from the lighting button 7.

Figure 5:
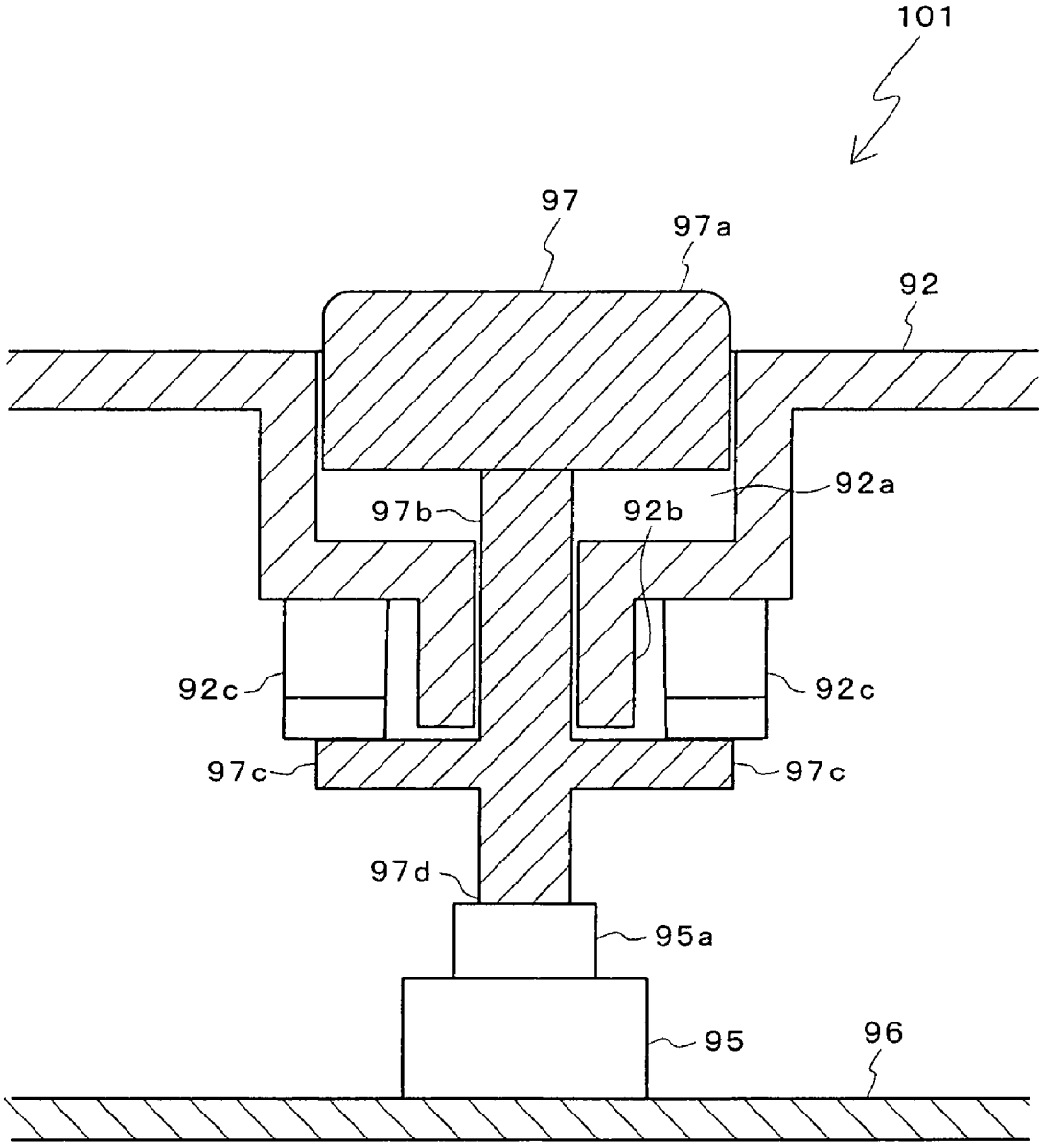
FIG. 5 is a view showing the other embodiment.

The present invention can employ various embodiments in addition to the embodiment mentioned above. For example, in the embodiment mentioned above, there is listed up the example in which the present invention is applied to the lighting button 7 swinging in accordance with the pressing operation, however, the present invention can be applied to the other buttons, for example, a button which is moved in parallel on the basis of the pressing operation. FIG. 5 is a view showing an embodiment in this case. A case 92 of a remote controller 101 (a whole of which is not illustrated) in accordance with the present embodiment is formed by injection molding synthetic resin. A board 96 and a press-in type switch 95 are stored in an inner portion of the case 92. In the board 96, there are mounted the switch 95, a circuit for transmitting a signal for operating an electronic apparatus (not shown) by remote control, a light emitting diode and the like. The circuit and the light emitting diode are the same as the transmission circuit 6*a* and the light emitting diode 64 as shown in FIG. 2. An inner portion of the switch 95 is provided with a contact which comes to an ON state by a movable portion 95*a* being pressed in, and a spring protruding the movable portion 95*a* on the basis of a predetermined elastic force. A button 97 pressing the switch 95 in accordance with a pressing operation so as to set to an ON state is arranged in an upper side of the switch 95. The button 97 is formed by injection molding synthetic resin. The button 97 is provided with an operating portion 97*a* pressed with a finger, and a shaft portion 97*b* extending in a vertical direction. The shaft portion 97*b* is integrally provided with a protruding portion 97*c* protruding to a side portion in parallel to the board 96 and the case 92, and a pressing portion 97*d* pressing the movable portion 95*a* of the switch 95. The case 92 is integrally provided with a concave portion 92*a* to which the operating portion 97*a* of the button 97 is fitted, a tube portion 92*b* through which the shaft portion 97*b* is passed, and a hook portion 92*c* having an elastic force which is weaker than a spring in an inner portion of the switch 95. The concave portion 92*a* and the tube portion 92*b* correspond to one embodiment of the support portion, and support the operating portion 97*a* and the shaft portion 97*b* so as to be movable in parallel in the vertical direction. The hook portion 92*c* has the same shape as that of the hook portion 25 shown in FIG. 1 or the like, corresponds to one embodiment of the elastic portion, and presses the protruding portion 97*c* to the board 96 side. In place of the hook portion 92*c*, the structure may be made such as to attach an independent elastic member such as a spring made of metal or synthetic resin, rubber or the like from the case 92 as the elastic portion to the case 92 so as to press the protruding portion 97*c* to the board 96 side. The button 97 is set immovable in a state of being capable of pressing so as to be held, by supporting the operating portion 97*a* and the shaft portion 97*b* of the button 97 by the concave portion 92*a* and the tube portion 92*b* of the case 92 so as to be movable in parallel in the vertical direction, supporting the pressing portion 97*d* of the button 97 by the movable portion 95*a* of the switch 95 from the board 96 side, and supporting the protruding portion 97*c* of the button 97 by the hook portion 92*c* of the case 92 from the opposite side to the board 96.

As mentioned above, since the operating portion 97*a*, the shaft portion 97*b*, the protruding portion 97*c* and the pressing portion 97*d* of the button 97 are set immovable so as to be held in the state of being capable of being pressed by the concave portion 92*a*, the tube portion 92*b* and the hook portion 92*c* of the case 92, and the movable portion 95*a* of the switch 95, that is, in the state of being spaced from the case 92 and the board 96, it is possible to eliminate the rattle of the button 97 at a time when the case 92 is shaken. Further, since the button 97 and the switch 95 are always in contact with each other so as to be prevented from being spaced, it is possible to prevent the button 97 from coming into collision with the switch 95 at a time of pressing the button 97 or at a time of canceling the operation. Further, since the button 97 and the hook portion 92*c* of the case 92 are always in contact with each other so as to be prevented from being spaced, or are spaced only at a time of pressing the button 97, it is possible to prevent the button 97 from coming into collision with the hook portion 92*c* at a time of canceling the pressing operation of the button 97, or it is possible to buffer the collision of the button 97 by the hook portion 92*c*. Further, since the elastic force of the hook portion 92*c* is weaker than the elastic force of the spring in the inner portion of the switch 95, in the case that the switch 95 is mounted to the board 96 in the floating state, the hook portion 92*c* is deformed at the floating degree, thereby preventing the movable portion 95*a* from coming to the state in which the movable portion 95*a* is always pressed in by the pressing portion 97*d*, and it is possible to secure a predetermined operating amount of the button 97. Accordingly, it is possible to prevent the discordant rattle noise and the operating sound of the button 97 from being generated without deteriorating operability of the button 97.

In the embodiment mentioned above, there is listed up the examples in which the present invention is applied to the remote controllers 100 and 101 operating the electronic apparatus 200 such as the projector or the like by remote control, however, the present invention can be applied to a remote controller operating various electronic apparatuses, for example, audio visual apparatuses such as a television set, a DVD player and the like, and home electric appliances such as an air conditioner, an electric light and the like, in addition to this.

What is claimed is:

1. A remote controller comprising:

a plurality of operating buttons operating an electronic apparatus by remote control;

a circuit transmitting a signal corresponding to each of the operating buttons;

a light lighting each of the operating buttons;

a tact switch actuating said light;

a lighting button pressing said tact switch so as to turn on said light;

a board mounting said circuit, said light and said tact switch thereon;

a case storing said board in an inner portion and holding said operating button and said lighting button so as to protrude to an outer portion in such a manner as to be operable by pressing; and said lighting button being arranged at a position with which a finger is in contact at a time of gripping said case by a hand in a used mode in an opposite side of said case to said operating button, wherein said tact switch is arranged at a facing position of said board to said lighting button, a pressing portion pressing said tact switch is integrally provided in a center portion of said lighting button, and an arm portion protruding to an opposite side to said tact switch is integrally provided in one end portion of said lighting button, wherein a flange portion protruding to an opposite side to said arm portion and said tact switch is integrally provided in the other end portion in an opposite side to the one end portion of said lighting button, a support portion rotatably supporting a tip of said arm portion so as to be vertically rotatable with respect to said board is integrally provided at a position of said case facing to said arm portion, and a hook portion having a weaker elastic force than said tact switch is integrally provided at a position of said case facing to said flange portion, wherein said arm portion is rotatably supported by said support portion, said pressing portion is supported by said tact switch from said board side, said flange portion is supported by said hook portion from an opposite side to said board, and said lighting button is made immovable in a state of freely swing by a pressing operation so as to be held, and wherein the supporting point of said arm portion by said support portion is moved away from the supporting point of said pressing portion by said tact switch, and the supporting point of said flange portion by said hook portion is moved close to the supporting point of said pressing portion by said tact switch.

2. A remote controller comprising:

a circuit transmitting a signal for operating an electronic apparatus by remote control;

a press-in type switch;

a board mounting said circuit and said switch thereon;

a button pressing said switch so as to actuate; and a case storing said board and said switch in an inner portion and holding said button so as to freely press to operate, wherein said case is provided with a support portion supporting said button so as to be movable in a direction moving close to said board or a direction moving away from the board, and an elastic portion having an elastic force which is weaker than an elastic force of said switch, and wherein when said button is not pressed, said button is movably supported by said support portion, is supported by said switch from said board side, and is supported by said elastic portion from an opposite side to said board.

3. The remote controller as claimed in claim 2, wherein said support portion and said elastic portion are integrally provided in said case.

4. The remote controller as claimed in claim 2 or 3, wherein said switch is arranged at a position of said board facing to said button, a pressing portion pressing said switch is provided in a center portion of said button, a first protruding portion protruding to an opposite side to said switch is provided in one end portion of said button, and a second protruding portion protruding to an opposite side to said first protruding portion and said switch is provided in the other end portion in an opposite side to the one end portion of said button, wherein a tip of said first protruding portion is supported by said support portion of said case so as to be vertically rotatable with respect to said board, said pressing portion is supported by said switch from said board side, said second protruding portion is supported by said elastic portion of said case from an opposite side to said board, and said button is made immovable so as to be held in a state of being freely swung by the pressing operation, and wherein the supporting point of said first protruding portion by said support portion is moved away from the supporting point of said pressing portion by said switch, and the supporting point of said second protruding portion by said elastic portion is moved close to the supporting point of said pressing portion by said switch.

5. The remote controller as claimed in claim 4, wherein said pressing portion, said first support portion and said second support portion are integrally provided in said button.

* * * * *